US006554662B1

(12) United States Patent
Hedlund et al.

(10) Patent No.: US 6,554,662 B1
(45) Date of Patent: Apr. 29, 2003

(54) HYDRAULIC SYSTEM IN A BOAT HULL, PREFERABLY A BOAT HULL HAVING AN OUTBOARD DRIVE

(75) Inventors: Benny Hedlund, Hono (SE); Mikael Asberg, Torslanda (SE)

(73) Assignee: AB Volvo Penta, Gothenburg (SE)

( * ) Notice: Subject to any disclaimer, the term of this patent is extended or adjusted under 35 U.S.C. 154(b) by 0 days.

(21) Appl. No.: 09/856,708

(22) PCT Filed: Nov. 25, 1999

(86) PCT No.: PCT/SE99/02195

§ 371 (c)(1),
(2), (4) Date: Oct. 24, 2001

(87) PCT Pub. No.: WO00/34119

PCT Pub. Date: Jun. 15, 2000

(30) Foreign Application Priority Data

Nov. 26, 1998 (SE) ..... 9804072

(51) Int. Cl.[7] ..... B63H 5/125

(52) U.S. Cl. ..... 440/61

(58) Field of Search ..... 114/144 R, 150, 114/151; 440/61

(56) References Cited

U.S. PATENT DOCUMENTS 4,749,374 A 6/1988 Ferguson
4,768,580 A * 9/1988 Ferguson ..... 165/132

* cited by examiner

*Primary Examiner*—Stephen Avila
(74) *Attorney, Agent, or Firm*—Young & Thompson

(57) ABSTRACT

An hydraulic installation in a boat hull for swinging a properller rig pivotably suspended in a shell on a boat transom using a piston-cylinder device arranged in a hydraulic control circuit. A control valve included in the hydraulic circuit for controlling the flow to and from the hydraulic cylinder is sealingly mounted in a through-opening in the shell, so that one side of the valve faces outwardly towards the propeller rig in order to be subjected to water spray during driving and serve as an oil cooler.

8 Claims, 3 Drawing Sheets

HYDRAULIC SYSTEM IN A BOAT HULL, PREFERABLY A BOAT HULL HAVING AN OUTBOARD DRIVE

CROSS REFERENCE TO RELATED APPLICATION

This is the 35 USC 371 national stage of international application PCT/SE99/02195 filed on Nov. 25, 1999, which designated the United States of America.

BACKGROUND OF THE INVENTION

The present invention relates to a hydraulic installation in a boat hull, comprising a hydraulic circuit with pump means, pressure medium-actuated operating means, control valve means for controlling the flow between the pump means and the pressure-actuated operating means, and cooling means for cooling the pressure medium in the hydraulic circuit The invention also relates to a boat propeller drive, comprising a shell intended to be permanently mounted against a boat transom, a propeller rig mounted in the shell for pivoting about a steering axis, at least one pressure medium-actuated piston-cylinder device, by means of which the propeller rig is pivotable about the steering axis, and a control valve for controlling the pressure medium flow to and from the cylinder of the piston-cylinder device.

In most hydraulic installations of the type described above, some form of cooling arrangement is required to prevent overheating of the pressure medium. Usually, a separate heat exchanger is used in the hydraulic circuit. The purpose of the present invention is, in a hydraulic installation of the type described by way of introduction, to make it possible to achieve satisfactory cooling of the pressure medium without using a separate heat exchanger only intended for cooling purposes.

SUMMARY OF THE INVENTION

This is achieved according to the invention by virtue of the fact that the control valve means comprise at least one control valve with a valve housing, which is so fixed relative to the boat hull, that at least a portion of the valve housing is exposed to the hull surroundings, to thereby serve as cooling means for the pressure medium in the hydraulic circuit.

By placing the valve housing so that its outside is subjected to water spray during driving, it can assume the function of a conventional separate cooler, meaning that a separate cooler can be eliminated without having to add a new component to the hydraulic circuit.

In a boat propeller drive of the above described type, particular advantages are achieved if the control valve has a valve housing which is so arranged on the shell that at least a portion of the valve housing is exposed towards the propeller rig.

The control valve can then be delivered as a portion integrated into the propeller drive with pre-installed hydraulic lines between the valve and the steering cylinder(s) of the rig. No after-mounting of the control valve is required, and by virtue of the fact that the valve is exposed towards the propeller rig, it will automatically be subjected to water spray when the boat is driven. In a preferred embodiment of the propeller drive according to the invention, the valve housing is sealingly fixed in a through-opening in the shell. In this case it is sufficient to connect the lines from the inboard-mounted pump devices to the valve housing connections on the inside of the shell. No lines need be drawn through the shell or the transom of the hull.

BRIEF DESCRIPTION OF THE DRAWINGS

The invention will be described in more detail with reference to examples shown in the accompanying drawings, where.

DETAILED DESCRIPTION OF THE PREFERRED EMBODIMENTS

Figure 1:
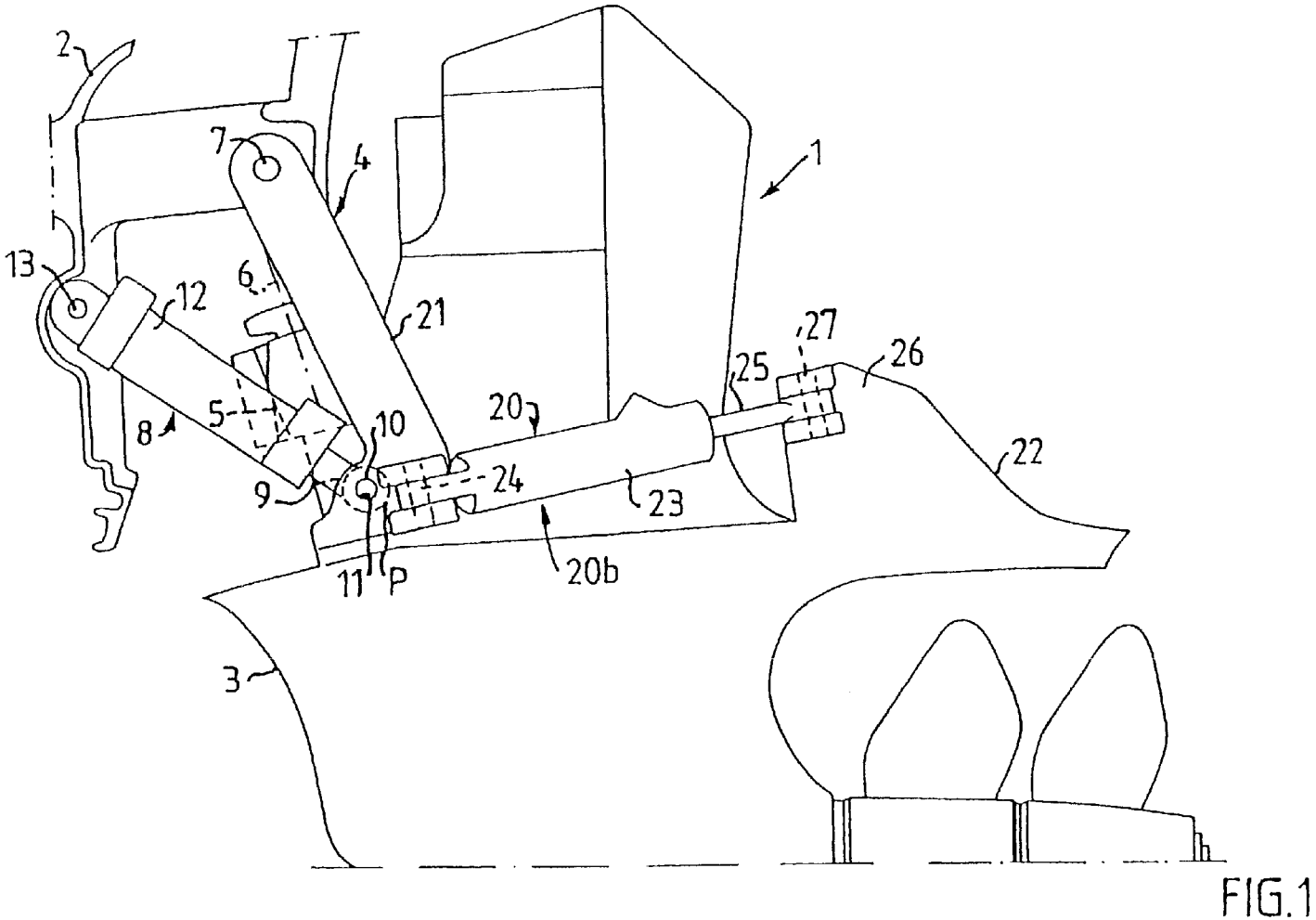
FIG. 1 shows a schematic side view of a boat propeller drive.

FIG. 1 shows an inboard/outboard drive 1 of Aquamatic® type, comprising a carrier or shell. 2, intended to be fixed to the transom and seal against the edges of an opening of the transom. The drive 1 has a rig leg 3, which is pivotally suspended in a fork-like carrying element 4 via a shaft 5, the center axis 6 of which forms the steering axis of the drive. The fork element 4 is journalled at its upper end in the shell 2 for pivoting about a horizontal axis 7. At its lower end, the fork element 4 engages a pair of piston-cylinder devices 8 arranged symmetrically about the shaft 5, only one of which being shown in the figure. In the example shown, the piston rod 9 of the respective device 8 is pivotally joined to the element 4 via a pin 10 in a bore 11 in the respective fork leg of the element 4, while each respective hydraulic cylinder 12 is pivotally mounted in the shell 2 via a pin 13. The piston cylinder devices 8 form so-called trim- and tilt-cylinders, by means of which the angle of the rig leg 3 can be trimmed during operation and by means of the rig leg can be swung up out of the water when at rest.

Two hydraulic piston cylinder devices 20*a* and 20*b* oriented symmetrically relative to the longitudinal plane of symmetry of the drive, are pivotally joined to the lower end of each leg 21 of the fork element 4 and the cavitation plate 22 of the drive. In the example shown, the cylinder 23 of the respective piston cylinder device 20 is joined to the respective fork leg 21 by means of a pin 24 while the respective piston rod 25 is joined to a mounting 26 on the cavitation plate via a pin 27.

Figure 2:
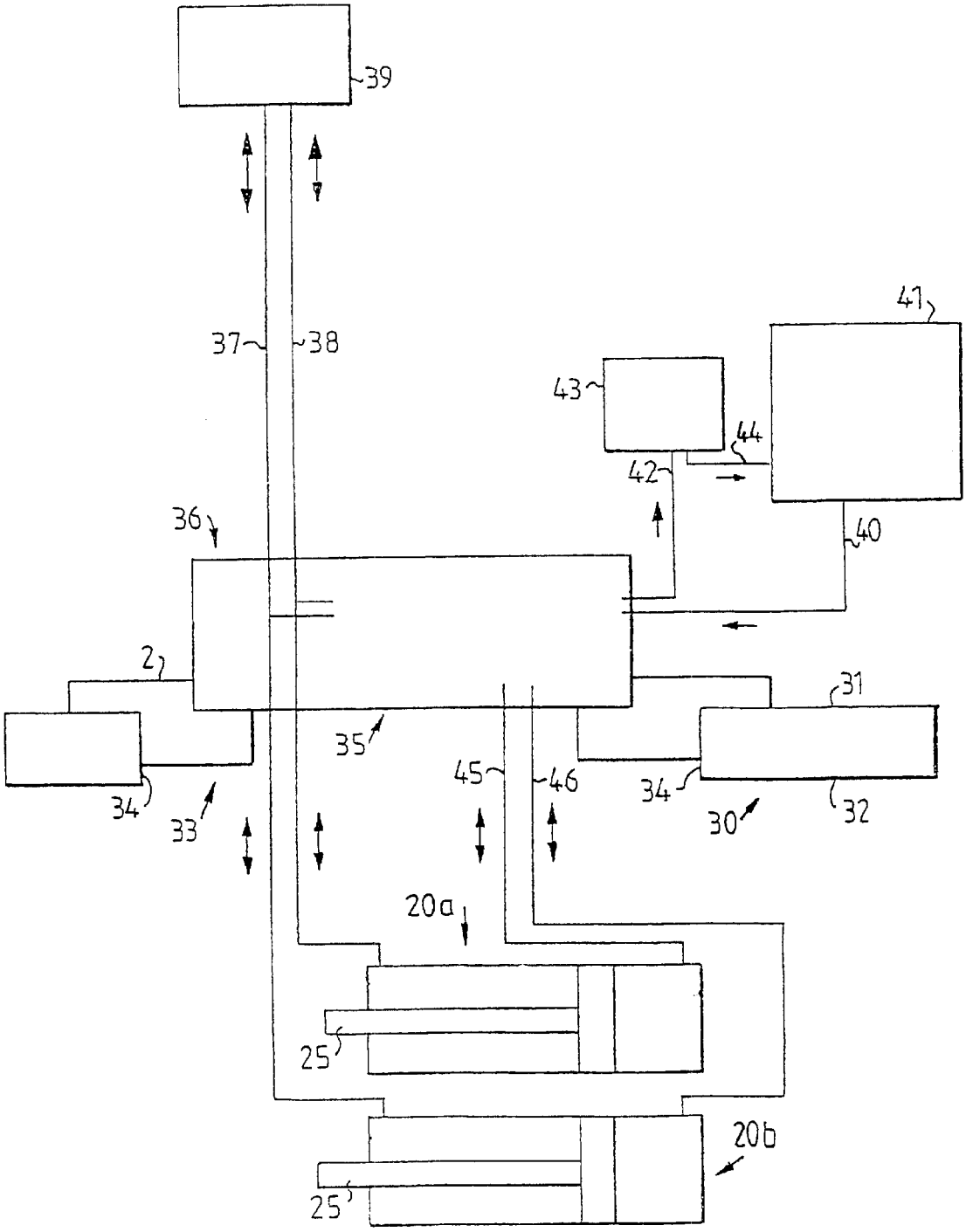
FIG. 2 shows schematically one embodiment of a hydraulic steering system for the boat propeller drive in FIG. 1.

The schematic drawing in FIG. 2 shows in cross-section a portion of a transom 30, where 31 designates its inside, 32 its outside and 33 a through-opening, against the edges 34 of which the shell 2 is sealingly fixed. In an opening 35 in the shell 2, a control valve 36 is sealingly fixed against the edges of the opening 35. The valve 36 communicates via lines 37 and 38 with a hydraulic pump 39 which is connected to a manual drive means (not shown in more detail here), e.g. a steering wheel, which, when turned, pumps hydraulic oil both to the control valve 36 and to and from cylinder chambers in the cylinders 20*a* and 20*b*, as will be described in more detail below with reference to FIGS. 3 and 4. The control valve 36 is also connected to a pressure line 40 from a hydraulic pump 41 driven by a drive motor (not shown) and via a line 42 to an oil reservoir 43, to which a suction line 44 to the pump 41 is connected. Via the control valve and the hydraulic lines 45, 46, oil can be pumped to and from cylinder chambers in the cylinders 20*a*, 20*b*. The valve can be of the type shown and described in our parallel patent application No. 9804073-6.

Figure 3:
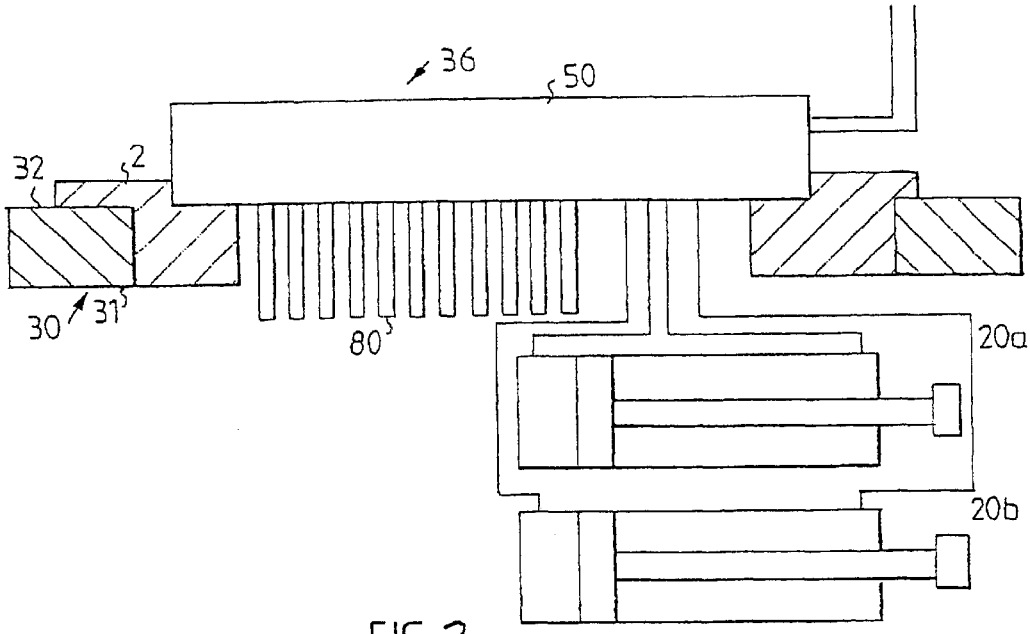
FIG. 3 shows a diagram of a second embodiment of a hydraulic steering system.
Figure 4:
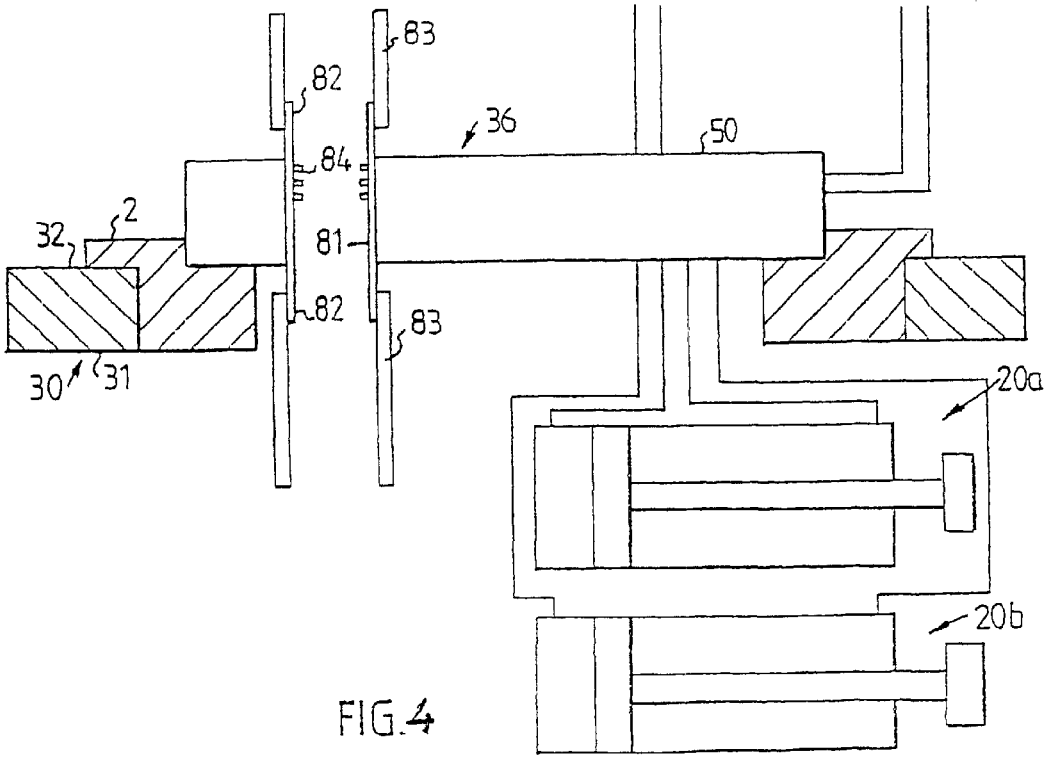
FIG. 4 shows a diagram of a third embodiment of a hydraulic steering system.

By virtue of the fact that the control valve 36 is mounted in an opening in the shell 2, so that its outside is subjected to water spray, it can serve as an oil cooler for the hydraulic oil in the system and thus, at least in certain installations, completely replace a separate oil cooler. In order to increase the cooling capacity of the control valve 36, it can, as shown in FIG. 3, be provided with cooling flanges 80 or, as shown in FIG. 4, be made with a channel 81, which extends through the housing 50 and at each end has connections 82 for coolant hoses 83 to the engine coolant. Possibly, the channel 81 can also be provided with cooling flanges 84.

The hydraulic installation according to the invention has been described above with reference to one embodiment in which the pressure medium-actuated operating means are steering cylinders in a hydraulic servo system, but the invention is of course not limited to servo steering systems. It can also be applied in hydraulic systems for controlling the flow, for example to trim cylinders for propeller drive units and trim planes.

What is claimed is:

1. Hydraulic installation in a boat hull, comprising a hydraulic circuit (37,38,45,46) with pump means (39,41), pressure medium-actuated operating means (20*a*,20*b*), control valve means (36) for controlling the flow between the pump means and the pressure-actuated operating means, and cooling means for cooling the pressure medium in the hydraulic circuit, characterized in that the pump means are located inside the hull and that the control valve means comprise at least one control valve (36) with a valve housing, which is so fixed relative to the boat hull, that at least a portion of the valve housing is exposed to the hull surroundings, to thereby serve as cooling means for the pressure medium in the hydraulic circuit.

2. Installation according to claim 1, characterized in that the valve housing, at least on the side exposed to the hull surroundings, is provided with cooling flanges (80).

3. Installation according to claim 1, characterized in that the valve housing is made with a through-channel (81), which has an inlet and an outlet (82) for connection to a coolant line (83).

4. Installation according to claim 3, characterized in that the inner wall of the channel (81) is provided with cooling flanges (84).

5. Installation according to claim 1 in a boat hull, which has a propeller drive (1) comprising a carrier (2) permanently mounted on the hull transom (30), and a propeller rig (3) mounted in the carrier for pivoting about a steering axis (6), the pressure medium-actuated operating means (20*a*, 20*b*) being active to pivot the propeller rig about the steering axis, characterized in that the valve housing is carried by the carrier (2).

6. Installation according to claim 5, characterized in that the carrier is a shell (2) mounted against an opening in the transom (30), said shell having a through-opening (35), in which the valve housing is sealingly fixed.

7. A boat propeller drive, comprising:

a shell intended to be permanently mounted against a boat transom;

a propeller rig which is mounted in the shell for pivoting about a steering axis;

at least one pressure medium-actuated piston-cylinder device, by means of which the propeller rig is pivotable about the steering axis;

a control valve for controlling the flow of pressure medium to and from the cylinder of the piston-cylinder device; and a pump means for pumping the pressure medium mounted inside the boat transom, wherein the control valve has a valve housing, which is so carried by the shell, that at least a portion of the valve housing is exposed towards the propeller rig.

8. Boat propeller drive according to claim 7, characterized in that the valve housing is sealingly fixed in a trough-opening (35) in the shell (2).

* * * * *